United States Patent [19]

Sevastakis

[11] Patent Number: 4,706,734

[45] Date of Patent: Nov. 17, 1987

[54] CONTINUOUS CASTING OF STRIPS OR BARS

[76] Inventor: Gus Sevastakis, 5645 Angola Rd., Toledo, Ohio 43615

[21] Appl. No.: 876,303

[22] Filed: Jun. 18, 1986

Related U.S. Application Data

[63] Continuation of Ser. No. 703,907, Feb. 21, 1985, abandoned.

[51] Int. Cl.[4] ..... B22D 11/124

[52] U.S. Cl. ..... 164/443; 164/485; 164/348

[58] Field of Search ..... 164/443, 485, 418, 128, 164/348

[56] References Cited

U.S. PATENT DOCUMENTS

| | | | |
|---|---|---|---|
| 3,519,062 | 7/1970 | Wertli | 164/443 |
| 3,625,498 | 12/1971 | Adamec | 164/443 X |
| 4,088,295 | 5/1978 | Medovar et al. | 164/443 X |
| 4,295,516 | 10/1981 | Wilson | 164/443 X |

*Primary Examiner*—Kuang Y. Lin

*Attorney, Agent, or Firm*—Barnes, Kisselle, Raisch, Choate, Whittemore & Hulbert

[57] ABSTRACT

A continuous casting apparatus comprising a graphite die having an opening therethrough which has an elongated cross section and a cooler body surrounding and supporting the die. The cooler body or graphite die has a plurality of axially extending coolant passages in transversely spaced relation along each of the long sides of the elongated opening. Each coolant passage has an inlet end and an outlet end and the length of the coolant passages decreases progressively from the passage nearest the center to the end of the elongated openings.

8 Claims, 14 Drawing Figures

NEW COOLER

CONTINUOUS CASTING OF STRIPS OR BARS

This application is a continuation of application Ser. No. 703,907, filed Feb. 21, 1985, now abandoned.

This invention relates to continuous casting and particularly continuous strip or bar casting.

BACKGROUND AND SUMMARY OF THE INVENTION

In the continuous casting of the metals such as brass or the like, it is common to permit molten metal to flow from a crucible through a die which is surrounded by a cooling apparatus so that the molten metal progressively solidifies and is intermittently withdrawn by a suitable apparatus. A major consideration in the efficiency of such an arrangement is the ability to remove heat from the die.

In my U.S. Pat. No. 4,285,388, an efficient apparatus for cooling the die is shown which utilizes a cooling sleeve having intimate contact with the exterior surface of the die, which cooling sleeve is cooled by flowing coolant about the periphery thereof. Inasmuch as the coolant comes into contact with the cooling sleeve which is cold and progressively increases in temperature, there is a tendency for the cooling sleeve to be cooled unevenly and expand out of contact with the die.

Where the product being cast is a strip or bar having an elongated cross section, it is very difficult to control the cooling so that the metal will solidify equally in a transverse direction with respect to the center line or longitudinal axis of the product being cast. When a conventional casting apparatus is used where the die is enclosed by a cooling sleeve there is a greater area of contact at the ends of the elongated cross section and the ends of the strip or bar being cast tend to solidify or freeze more rapidly than the center. As a result, the solidification or freezing line on the cast product tends to follow a negative sine curve. Accordingly, it has been found that it is necessary that the die must be very long in the direction of movement of the metal and the metal must be subjected to very slow cooling in order to provide reasonable quality at very slow production rates. Among the difficulties with such apparatus is that fractures tend to develop in the corners of the cast strip or bars, limiting the use of the product, and the fractures tend to become enlarged on further processing of the product.

When the casting is conducted by the movement of metal upwardly, known as up casting, the cooling sleeve and forming die are submerged in molten metal. As a result, more uniform cooling is required. As the cast product moves upwardly, the hot metal entering the die must move very rapidly in order to carry away sufficient heat to prevent remelting, must solidify in the shortest possible time and be strong enough to move away from the freezing zone in the die without fracturing the outer skin or surface of the product being cast. The solidification or freezing zone must be maintained horizontal with respect to the vertical direction of withdrawal of the product and the solidification must occur rapidly so that the product can be moved upwardly with minimum friction relative to the forming die.

Where the strip or bar is being cast vertically downwardly, known as down casting, the molten metal enters the die at the top and the ferrostatic pressure and heat of the molten metal tend to remelt the solidifying product at the end of each intermittent withdrawal stroke of the withdrawing apparatus. This results in this zone being only partly solidified transversely and moved to the next zone of the die. Thus, once again, the solidification or freezing zone of the product being cast should comprise a very narrow solidified band which is strong enough to be moved into the next zone of the forming die.

In casting of ingots where a greater mass of molten metal is to be cooled in the shortest possible time, a rapid cooling action is also required and a large amount of heat must be removed from the molten metal in the shortest period of time in order to produce a high quality ingot and a high rate of production.

It is therefore desirable to provide a construction for making such products which is capable of cooling all portions of the product uniformly to produce a substantially straight solidification or freezing line transversely of the axis or direction of movement of the product through the die. Otherwise, any portions that solidify at a later time in the movement of the metal may result in point of incipient leaking through of the eutectics of the alloy which have a lower melting point than the remainder of the alloy producing exudation or beads on the surface of the cast product. Such eutectics tend to pierce the surface of the strip or bar being cast and, as the piercing continues, molten metal flows through the apertures that have been formed carrying with it a volume of heat which, in turn, melts the outer surface of the product being cast and eventually results in interruption in the casting operation.

Accordingly, among the objectives of the present invention are to provide a continuous casting apparatus for casting products which have an elongated cross section wherein the freezing line on the finished product is substantially transverse to the axis of the product; wherein the apparatus can be adjusted to accommodate changes in the product being cast or the molten temperature; and wherein the structure is economical to construct and operate.

In accordance with the invention, the continuous casting apparatus comprises a graphite die having an opening therethrough which has an elongated cross section and a cooler body surrounding and supporting the die. One of the graphite die and body has a plurality of axially extending coolant passages in transversely spaced relation along each of the long sides of the elongated opening. Each coolant passage has an inlet end and an outlet end and the length of the coolant passages decreases progressively from the passage nearest the center to the end of the elongated openings.

DESCRIPTION

Figure 2:
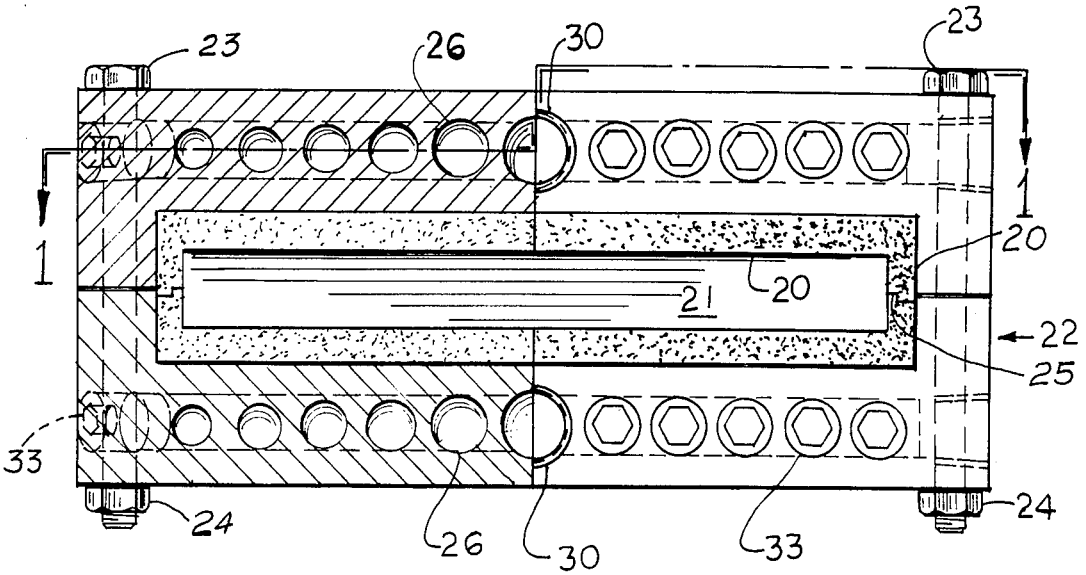
FIG. 2 is a sectional view taken along the line 2—2 in FIG. 1.
Figure 1:
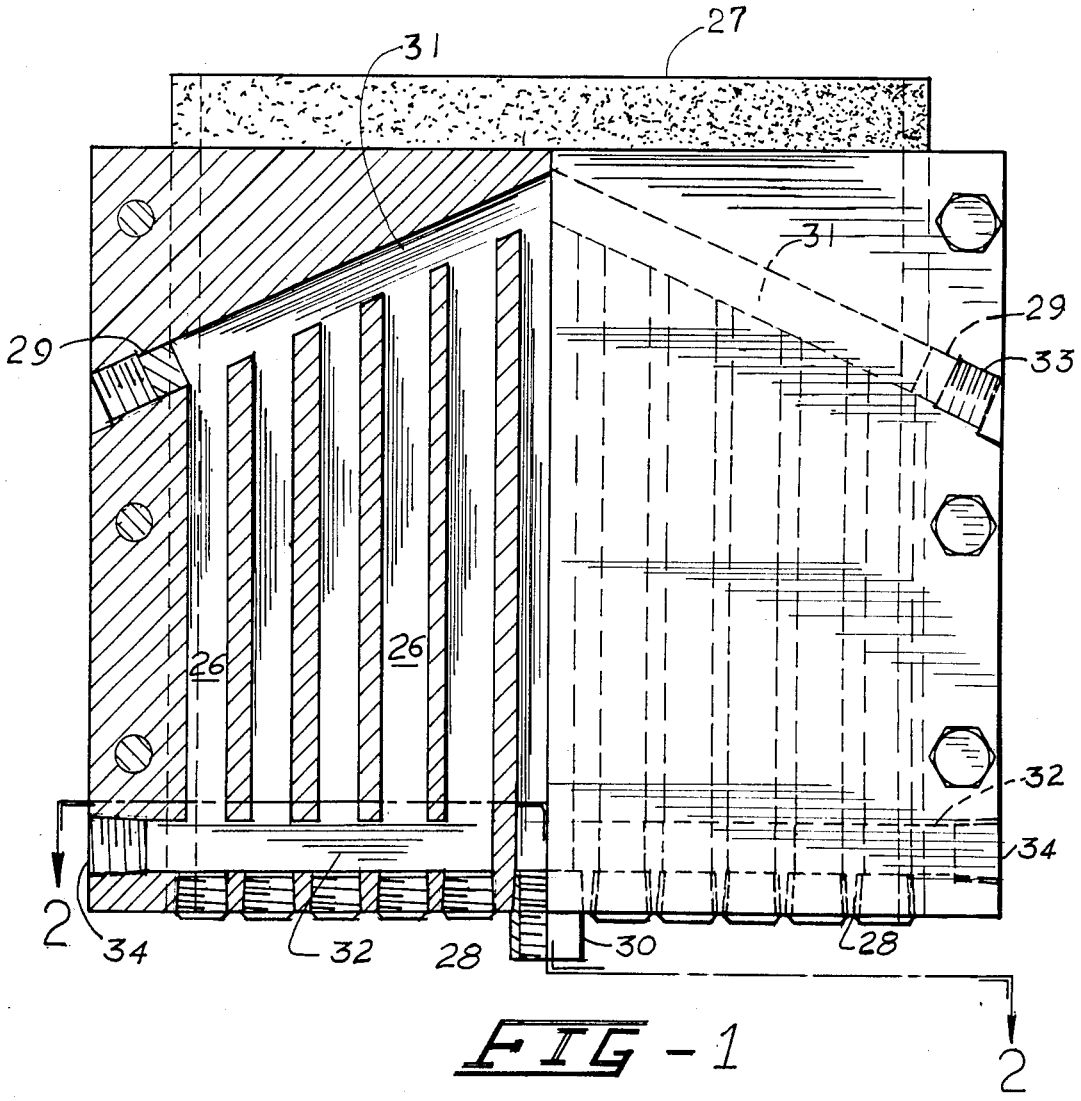
FIG. 1 is a plan view of a continuous casting apparatus embodying the invention.

Referring to FIGS. 1 and 2, the continuous strip casting apparatus embodying the invention comprises a graphite die 20 comprising two halves which are clamped together to form an elongated opening 21 having long sides and short sides. The die is held together by a cooler body 22 comprising plates held together by bolts 23 and nuts 24.

The graphite die 20 includes interengaging surfaces 25 and shoulders at the ends of the opening 21 which minimize and prevent any tendency of molten metal to pass through the contacting surfaces. Each of the parts of the cooler body 22 is provided with a plurality of axial coolant passages 26 which extend from the inlet end 27 of the cavity 21 to the outlet end 28 of the cavity 21, each of which has one end adjacent the inlet. The ends of the coolant passages 26 adjacent the inlet are on the same transverse plane, while the length of the passages decreases progressively from the center of the die toward the short sides.

Cooling fluid is introduced through an axial passage 30 to transverse passages 31 at the inner ends intersecting with the axial passages 26 and thereafter flows in a countercurrent fashion to the flow of the molten metal to transverse outlets 32.

When this apparatus is utilized, the molten metal is introduced to the cavity 21 from the inlet 27 as shown in FIG. 1 and is cooled from circulating coolant passing through the passages 26. Because of the arrangement, the cooling in the center of the cavity is greater than the ends so that the strip or bar being cast is solidified uniformly transversely of the strip or bar and the resultant freezing line is at substantially a right angle transverse to the axis of the bar.

Referring more specifically to FIGS. 1 and 2, the first set of passages 26 includes an axial coolant inlet passage 30 that extends from adjacent the outlet end 28 of the opening 21 axially toward the inlet end 27 and is connected by passages 31 inclined to the axis of the opening 21 to the ends of the axial passages 26 nearest the inlet end 27 of the opening 21. The exit end of the passages 26 communicates with transverse coolant outlet passages 32 extending to the exterior of the body 22 into the outlet 34. Plugs 33 are provided in alignment with the ends of the axial passages 26, also at the ends of the transverse passages 31. Other blocks 29 assist in diverting the coolant flow. The angle A formed by the passage 31 and the transverse edge of the cooler body vary according to the thickness of the cast products. (The angle A decreases when the thickness increases and vice versa.)

Figure 4:
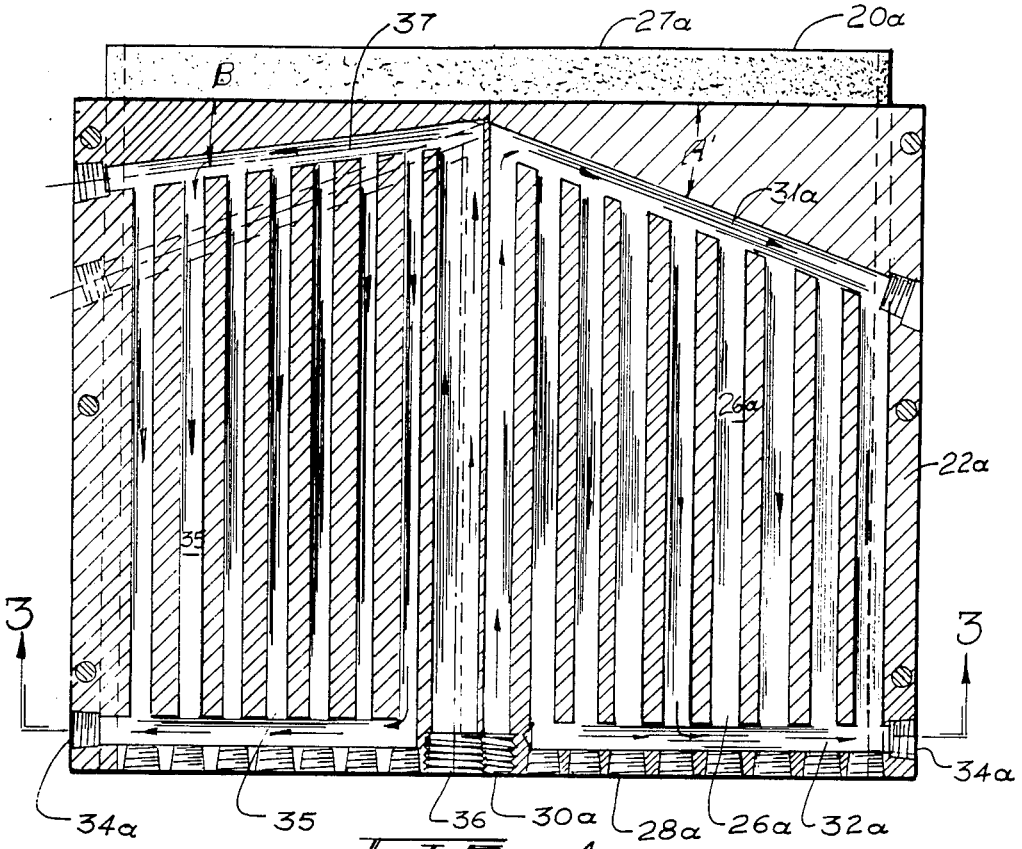
FIG. 4 is a sectional view taken along the line 4–4 in FIG. 3.
Figure 3:
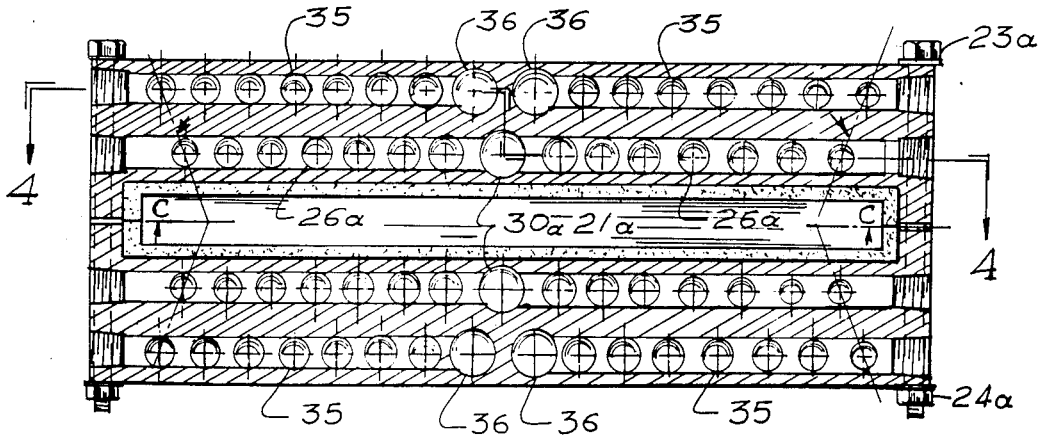
FIG. 3 is sectional view of a modified form of continuous casting apparatus taken along the line 3—3 of FIG. 4.

In the form shown in FIGS. 3 and 4, a first set of axial coolant passages 26*a*, axial inlet passages 30*a*, inclined passages 31*a*, and transverse outlet passages 32*a* are provided as in FIGS. 1 and 2. A second set of axial passages 35 is divided into two groups or sets, each set being provided with a separate coolant inlet axial passage 36 that extends from the outlet end 28*a* of the opening 21*a* toward the inlet end 27*a* and communicate with a transverse passage 37 extending transversely of the ends of the axial passages 35 to outlet 34*a* of the apparatus. The axial passage 30*a* and the transverse opening 31*a* of the inner row of passages 26*a* adjacent to the casting cavity 21 forms the angle A and the axial inlet 36 with the transverse passage 37 of the outer row of passages 35 form an angle B. The inlet 30*a* and the transverse passage 31*a* form an angle A with respect to a transverse plane larger than the angle B, and the axial cooling passages 26*a* are shorter in length than the cooling passages 35 of the outer row.

Thus, the coolant enters through the coolant inlet passages 30*a* and 36 and moves counter to the movement of the molten metal through the die toward the inlet of the die where the molten metal is being solidified.

In this form, the diameters of passages 26*a*, 35 decrease progressively from adjacent the respective axial inlet passages 30*a*, 36 toward the short sides.

Inasmuch as the greatest amount of cooling action is required at the center of the cross section of the product that is being cast and the incoming coolant at its lowest temperature travels at the center of the cast products, the passages adjacent the center have a greater length and greater diameter, closer to the forming die, and therefore a greater cooling action than those adjacent the short ends of the opening.

In order to provide a better control of the cooling action, the angle formed by the ends of the passages 26*a* adjacent the outlet in the first set of passages is greater than the angle formed by the ends of the passages 35 in the second set of axial passages. The passages 26*a*, 35 become progressively smaller in diameter as they approach the short end of the die.

Figure 5:
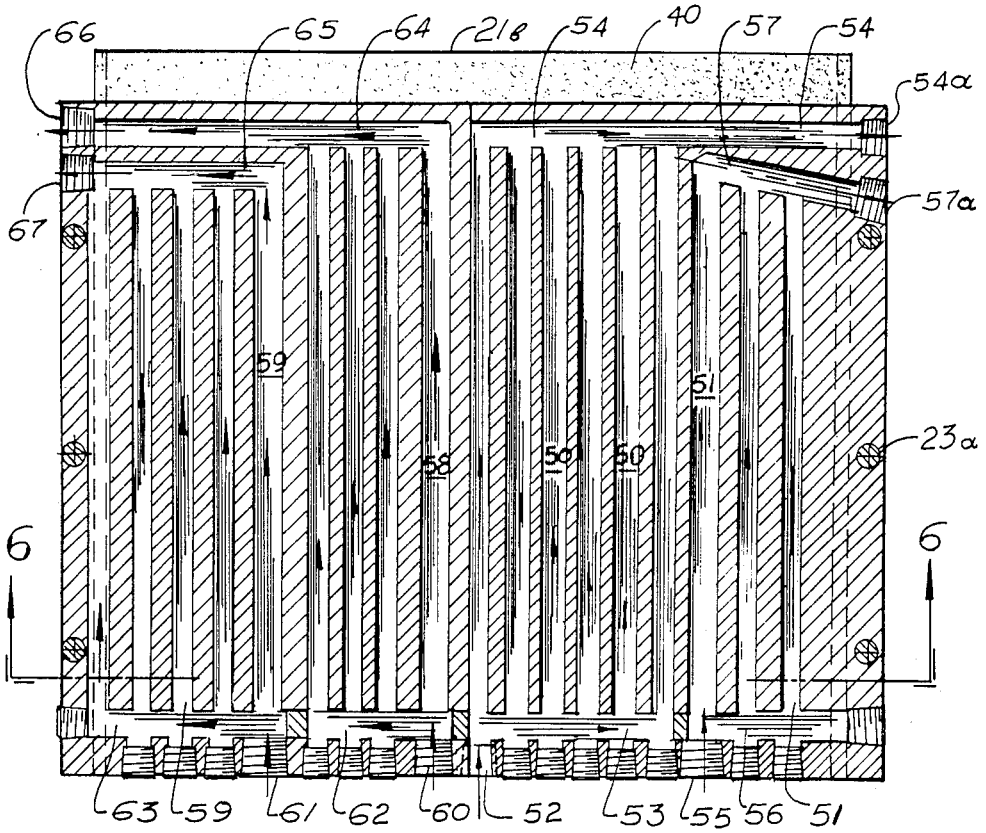
FIG. 5 is a sectional view of a further modified form of continuous strip casting apparatus taken along the line 5–5 in FIG. 6.
Figure 6:
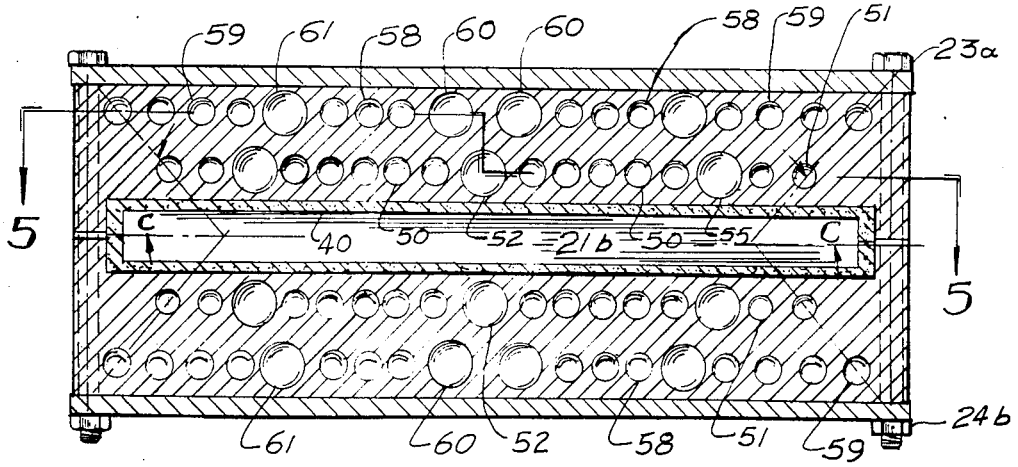
FIG. 6 is a sectional view taken along the line 6–6 in FIG. 5.

In the form of the invention shown in FIGS. 5 and 6, further control of the flow is provided by separating the axial passages into further sets in each axial plane of passages so that separate coolant can be provided to each group, which coolant may be at different volumes and temperatures. Thus, referring to FIGS. 5 and 6, one set of passages lying in the plane nearest the elongated opening 21*b* includes a first group of axial passages 50 having equal lengths and a second group of axial passages 51 of differing lengths. The first group is supplied from inlet 52 to the transverse passage 53 to the axial passages 50 and to the transverse passages 54 to the outlet of 54*a*. The second set of passages 51 nearest the short sides of the opening has a separate coolant inlet 55 connected by a transverse passage 56 and flowing in the same direction to an inclined outlet passage 57 and to the outlet 57*a*, thereby reducing the cooling action adjacent the short sides.

In the second row or set of passages furthest from the elongated opening 21*b* of the graphite mold 40, the passages are in two groups from each side of the center line, as shown on the left hand side in FIG. 5. The first group of passages 58 is longer than the second group of passages 59 and are supplied by separate coolant inlets 60, 61 to transverse passages 62, 63. Transverse outlet passages 64, 65, are connected to passages 58, 59 and extend to outlets 66, 67, respectively.

As seen in FIG. 5, the inlet 52 directs the coolant axially toward the intake of the metal through the center of the cooler body, from the transverse passages 53 to passages 50 away from the short end of the die cavity and out through both sides of the transverse openings 54 to outlet 54*a*. The inlet 55 directs the coolant toward the metal intake through the transverse opening 56 to the axial passages 51 and with the coolant at higher temperatures moving counter to the movement of the metal and with less heat extracted, exhausts through 57*a*.

Figure 7:
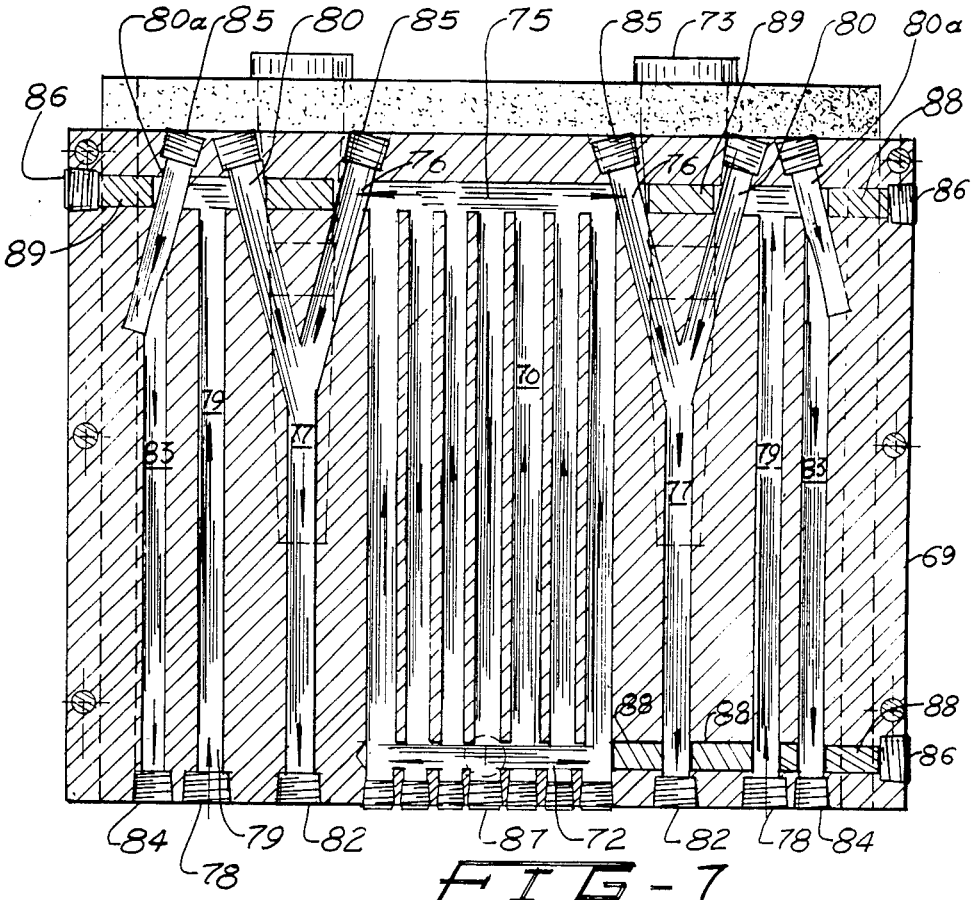
FIG. 7 is a sectional view taken along the line 7–7 in FIG. 8.
Figure 8:
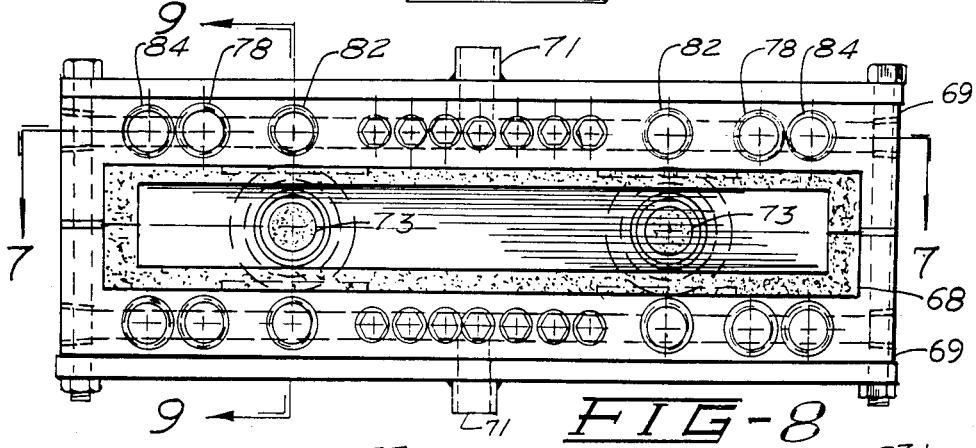
FIG. 8 is a front elevational of a horizontal continuous cast apparatus.
Figure 9:
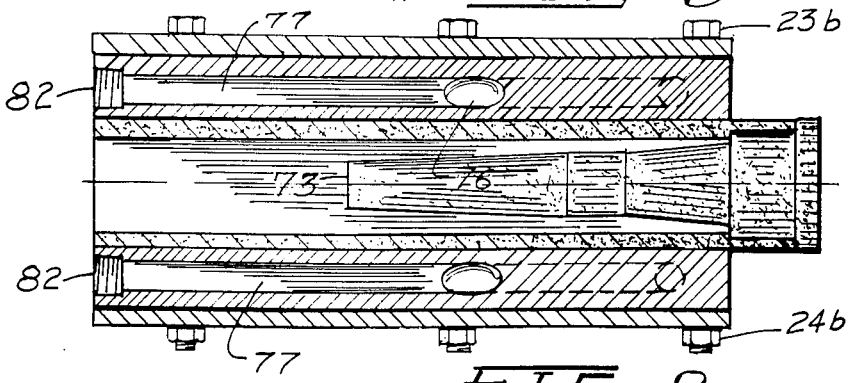
FIG. 9 is a sectional view taken along the line 9—9 of FIG. 8.

The axial passages 59 and 51 nearest the short end of the graphite mold are arranged in such array that they form an angle C which directs the coolant away from the short end of the mold so as to avoid premature solidification on the casting strip and to form a freezing line straight and transversely of the axial movement of the cast products. The angle C is increased when the casting strip has a greater thickness and is decreased when the thickness of the casting strip decreases in thickness. The curve that appears at the casting strip which resembles the negative sine curve can be eliminated and, if the angle C approaches the proper magnitude, the curve will form a substantially straight line.

Where the strip being cast in addition to having an elongated cross section includes axial openings, an apparatus such as shown in FIGS. 7–9 can be used wherein the graphite die halves 68 are clamped in a cooler body 69 and the body has a set of axial passages along the elongated portion of the die. A first group of passages 70 extends axially at the space between the mandrels 73 that will define the openings in the cast product and are supplied by coolant inlet 71 through a transverse passage 72 and to the ends of the passages 70 nearest the inlet of the die, coolant flowing counter to the flow of the metal toward a transverse outlet passage 75, and through the angular apertures 76 to axial outlet 77. The second set of openings 79 adjacent each end or the short side of the opening comprises an inlet 78 that supplies to the axial passage 79 that, in turn, extends to inclined passages 80 and 80*a* that straddle the plane of the inserts and intersect to an axial outlet passage 77, one of the inclined passages 80 communicating with the outlet 82 from the center passages. A second inclined passage 80*a* extends at an angle to a further axial outlet passage 83 to the exit 84. In the form of the invention shown in FIGS. 7–9, the passages have different lengths at various positions are inclined to divert the coolant at a place not needed and passages return to exit in the same directon that the hot metal moves. Coolant is diverted from places not needed on top of the apertures when it has reached the maximum temperature.

In the manufacture of the apparatus shown in FIGS. 7–9, plugs 85, 86, 87 are provided for closing the various passages after drilling and spacers 88, 89 are provided in the transverse passages after drilling so that the final coolant passages are isolated form one another.

Figure 10:
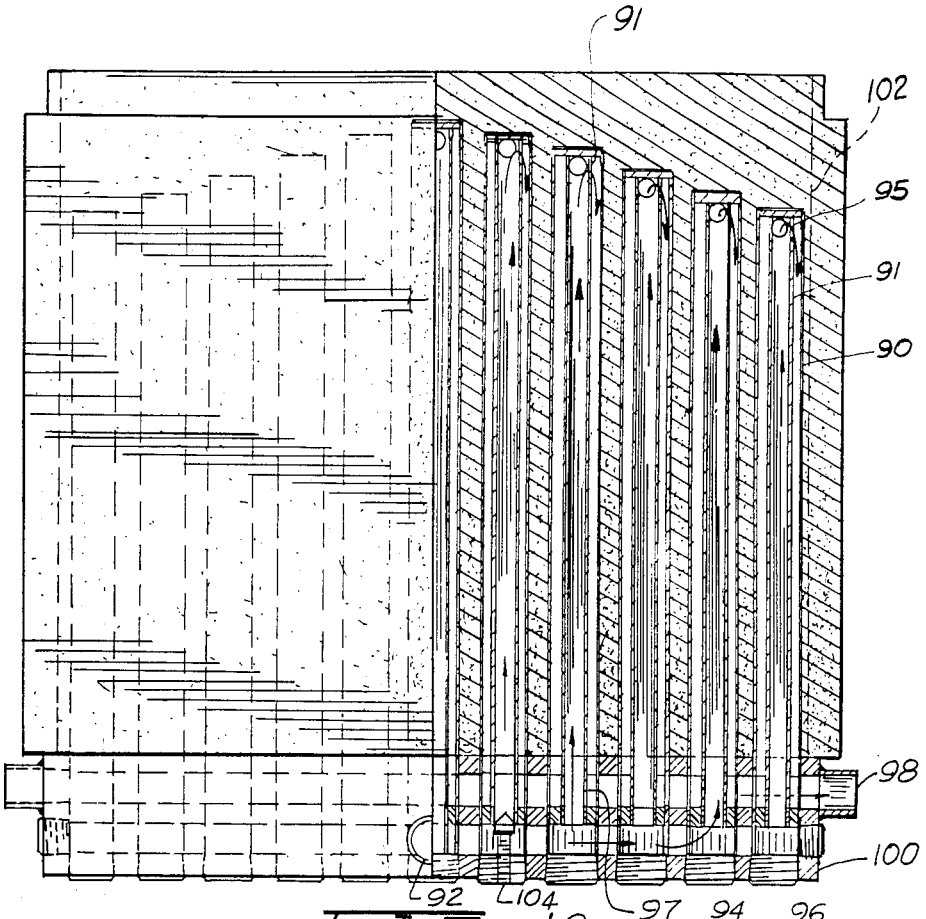
FIG. 10 is a part sectional plan view taken along the line 10—10 in FIG. 11.
Figure 11:
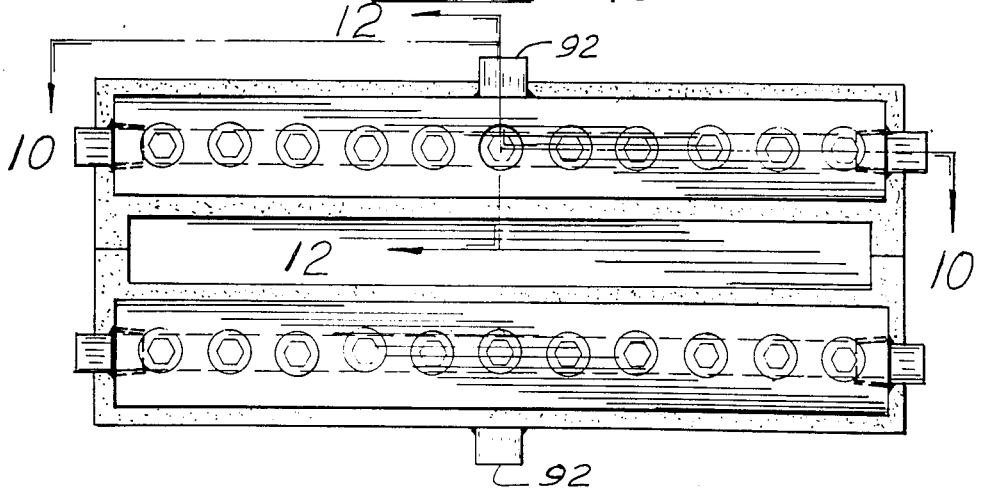
FIG. 11 is a front elevational view of the die assembly.

In the form of the invention shown in FIGS. 10–11, the passages have different lengths in the manner of FIGS. 1 and 2, but each is defined by concentric tubes 90, 91 and cooling is provided to the inner tube 91 through the intake 92, positioned centrally of the long side of each half of said graphite die, to the transverse passage 94 into the inner tube passages 91 toward the incoming movements of the metal, and through the aperture 95 to the outer tube passage 90 and through the apertures 96 to the transverse opening 97 into outlet 98 of the manifold 100. The assembly 100 is embedded into the graphite mold through the aperture 102 with special liquid material for better thermotransfer conductivity between the tube-like manifold and the graphite die. The tubes 90 progressively form an angle from the center toward the short side of the cavity for better control of the freezing line transversely to the axial center line of the cast strip products.

Figure 12:
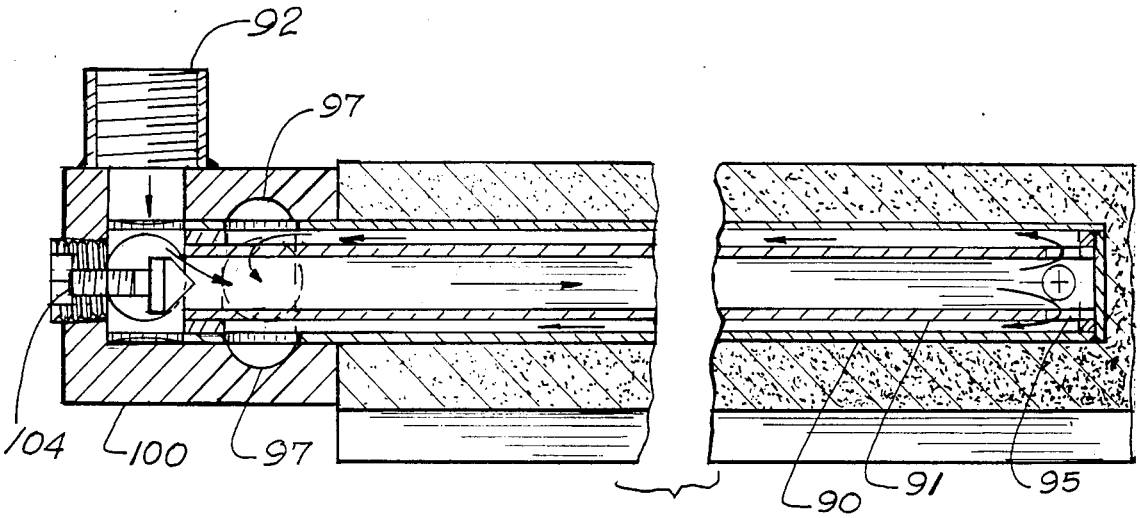
FIG. 12 is a fragmentary sectional view on an enlarged scale taken along the line 12—12 in FIG. 11.

Further control of the coolant provided with adjusting mechanism 104 is shown at FIG. 12.

Figure 13:
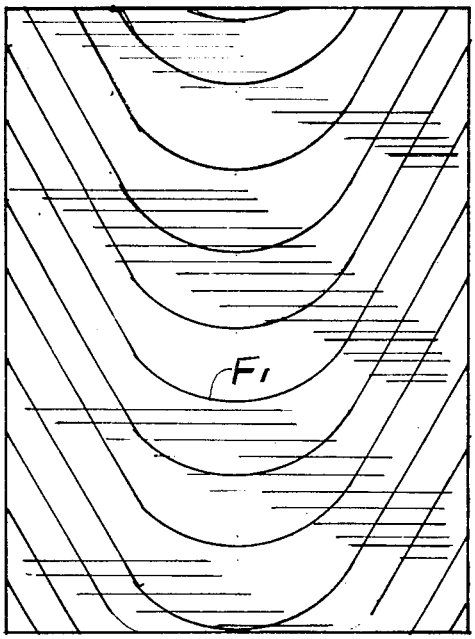
PRIOR ART FIG-13
FIG. 13 is a longitudinal view of the end of a prior art cast bar.
Figure 14:
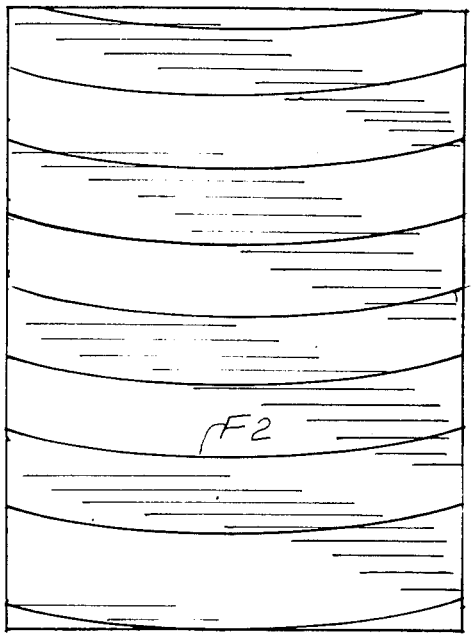
FIG. 14 is a longitudinal view of the end of a cast bar made in accordance with the invention.

Referring to FIG. 13, the bars cast in prior art apparatus are characterized by freezing lines $F_1$, which define a negative sine curve and, as discussed above, require longer dies which are operated at lower rates. As shown in FIG. 14, apparatus embodying the invention are characterized by freezing line $F_2$ which are substantially straight or transverse to the axis of the bar being cast.

In each of the forms, the graphite die and cooler body may be enclosed and surrounded by insulation or refractory material, not shown, so that they can be mounted on a furnace as a unitary apparatus to minimize sudden changes in temperature at start up and during casting.

I claim:

1. A continuous strip casting apparatus comprising a graphite die having rectangular long and short sides and an opening therethrough and having flat continuous planar outer contacting surfaces, said opening having an elongated cross section including rectangular long sides and short sides, said opening having an inlet end for the molten metal to enter the cavity and an outlet end for the solidified metal to exit the cavity, a cooler body associated with the graphite die, said cooler body comprising two U-shaped halves having a long side and short sides, said short sides of each half of said cooler body extending toward one another along the short sides of the die into closely spaced adjacent relation having flat continuous planar inner contacting surfaces engaging the outer contacting surfaces of said graphite die such that said two halves substantially surround and support said graphite die with the contacting surfaces in heat exchange relationship, means for holding the two halves of said cooler body in position surrounding and supporting the graphite die, a plurality of axially extending passages entirely within each half of said cooler body in transversely spaced relation along each of the long sides of the elongated opening, each axial passage extending from adjacent the outlet end of the graphite die axially toward the inlet end, the ends of said axial passages adjacent the outlet end of said graphite die terminating substantially in a transverse plane, the other ends of at least a portion of said axial passages lying in a plane forming an angle with the axis of the opening such that the length of the axial passages decreases progressively from the center of the die cavity toward the short end of the die, a coolant inlet passage entirely within each half of said cooler body extending centrally of said cooler body and axially from adjacent the outlet end of the graphite die toward the inlet end of said graphite die such that coolant flows directly through said coolant inlet passage from adjacent the outlet end of the die to the inlet end, a pair of transverse outlet passages entirely in each half of the cooler body intersecting the axially extending inlet passage and extending laterally outwardly from said coolant inlet passage and said axial passages at the ends nearest the inlet to said graphite die such that coolant flows through said transverse passages and thereafter through said axial passages in direction away from the inlet end of the die to the outlet end of the die, and transverse coolant outlet passages entirely within each half of the cooler body connecting the ends of said axial passages in each said half adjacent the outlet end of the graphite die, said cooler body having outlets communicating with said transverse coolant passages adjacent the intersection of the transverse coolant passages with each outermost axial passage nearest the short side of the cooler die such that the coolant flows from the ends of said axial passages, whereby the freezing line of the strip being cast comprises a substantially straight line transversely of said axis of said opening in said die.

2. The continuous strip casting apparatus set forth in claim 1 wherein the ends of said axial passages adjacent the inlet of the graphite die are all positioned such that the length of the axial passages decreases progressively from adjacent the center of the elongated opening toward the short sides of the elongated opening.

3. The continuous strip casting apparatus set forth in claim 1 wherein a second set of axial passages is provided in each half of the cooler body and extends in generally parallel relation to the first-mentioned axial passages adjacent the outlet end of the graphite die axially toward the inlet end, said second set of axial passages having their ends adjacent the outlet end of the graphite die lying substantially in a transverse plane, the other ends of the axial passages adjacent the inlet end of the graphite die having at least a portion thereof extending on a plane forming an angle with the axis of the elongated opening such that the length of the axial passages decreases progressively, said body having a coolant inlet passage associated with said second set of axial passages extending centrally of said cooler body and axially from the outlet end of the graphite die and communicating with the ends of said axial passages nearest the inlet of the graphite die, said body having transverse coolant outlet passages communicating with the ends of axial passages in each half nearest the outlet end of the graphite die, said cooler body having outlets communicating with said transverse coolant passages adjacent the intersection of the transverse coolant passages with each outermost axial passage nearest the short side of the cooler die.

4. The continuous strip casting apparatus set forth in claim 3 wherein the ends of the axial passages adjacent the inlet are positioned such that the length of the axial passages decreases progressively from adjacent the center of the elongated opening toward the short sides of the elongated opening.

5. The continuous strip casting apparatus set forth in claim 4 wherein the angle formed by the ends of the axial passages adjacent the inlet end of the graphite die in the first-mentioned axial passages differs from the angle formed by the ends of the axial passages of said second set of axial passages.

6. The continuous strip casting apparatus set forth in claim 5 wherein a separate coolant inlet is provided for those axial passages of said second set which are positioned in one direction transversely from the center of the elongated opening and another separate coolant inlet is provided for those axial passages which are positioned transversely in the opposite direction from the center of the elongated opening.

7. The continuous strip casting apparatus set forth in claim 6 wherein the axial passages have decreasing diameters in a direction from the center toward the short sides of the opening in the die.

8. The continuous strip casting apparatus set forth in claim 1 wherein said means for holding the two halves of said cooler body and graphite die in position comprises a plate extending along and engaging the outer surface of the long side of each half of the cooler body.

* * * * *